United States Patent [19]

Nishida

[11] Patent Number: 4,922,615

[45] Date of Patent: May 8, 1990

[54] PUNCHING TOOL

[76] Inventor: Rikio Nishida, 840 Matsuyacho, Fushimi-ku, Kyoto, Japan

[21] Appl. No.: 255,633

[22] Filed: Oct. 11, 1988

[30] Foreign Application Priority Data

Dec. 15, 1987 [JP] Japan ..... 62-190945[U]

[51] Int. Cl.[5] ..... B21D 28/24; B26F 1/00

[52] U.S. Cl. ..... 30/360; 30/361; 30/362; 30/363

[58] Field of Search ..... 30/363, 362, 361, 360, 30/272 R; 173/171; 81/177.7, 177.8

[56] References Cited

U.S. PATENT DOCUMENTS 2,359,699 10/1944 Valentine ..... 30/361 X
3,344,519 10/1967 Goodman ..... 30/362
4,006,784 2/1977 Dudek ..... 173/170 X
4,057,897 11/1977 Seymour ..... 30/272 R
4,495,699 1/1985 Oakes ..... 30/361 X
4,602,532 7/1986 Unger ..... 81/177.8 X

*Primary Examiner*—Douglas D. Watts
*Assistant Examiner*—Rinaldi Rada
*Attorney, Agent, or Firm*—Welsh & Katz, Ltd.

[57] ABSTRACT

The punching tool of the subject invention has a handle and a hand grip which can be rotated to any position convenient for use, so that the punching operation can be performed easily, irrespective of the shape of the object being treated. The manual hydraulic pump of the tool is connected for rotation to one end of a tubular connector, while the other end of this tubular connector is connected to a hydraulic cylinder in such a manner that the tubular connector can be turned about an axis perpendicular to the axis of the hydraulic cylinder.

5 Claims, 2 Drawing Sheets

PUNCHING TOOL

The present invention relates to a punching tool for enlargement of preformed mounting holes provided in chassis, panels or similar parts formed from steel or aluminum sheets.

BACKGROUND OF THE INVENTION - PRIOR ART

Panels which are made from steel sheets or similar materials are often obtained from a factory with prepunched holes which are designed for mounting parts, such as electric parts. These preliminary holes, which have diameters of about 20 mm, very often must be enlarged to diameters which are several times greater in size. Such an enlargement operation is usually fulfilled with the use of a portable hydraulic punching tool which comprises a cylindrical handle which forms an oil reservoir and is connected to a cylindrical portion of a larger diameter. This larger-diameter portion forms a hydraulic cylinder actuated by a manual hydraulic pump driven from a pivotally connected hand lever. The pump sucks a hydraulic fluid from the above-mentioned reservoir for supply under pressure to the above-mentioned cylinder. A ram of this hydraulic cylinder is connected to a punching rod. When hydraulic pressure is applied to the punching rod and the rod is moved, it compresses a coil spring which engages the ram and accumulates energy for the return stroke of the ram. The actual operation is performed by fitting a fixed die, which corresponds to the diameter of the enlarged hole, via a distant collar onto the punch rod which projects from the hydraulic cylinder. The punch rod is passed through the above-mentioned preformed hole of the sheet panel, and then a piercing punch, which cooperates with the fixed die, is screwed onto a threaded portion of the above-mentioned rod from the opposite side of the steel sheet. When the punch rod is moved, the portion of the steel sheet which is clamped between the piercing punch and the fixed die is sheared, and as a result, the preformed hole is enlarged to the required diameter.

A typical punching tool of the type described above has a 200 mm-long housing, a 120 mm-long punch rod portion projecting from the housing, and a 320 mm-long overall dimension. It is understood that the punching tool of such a size cannot be used in narrow spaces.

It has been proposed to provide a device consisting of a hydraulic cylinder and a punch rod connected to a ram of the above-mentioned cylinder with the punch separated from the unit connected to a portable manual hydraulic pump via a high pressure hose. The use of a separated punch unit, however, required an assistance of an auxiliary worker. Without the help of an auxiliary worker it would not be so easy to perform the punching operation.

The author of the present patent application has made an attempt to solve the above problem by providing a hole-piercing punch with a hydraulic cylinder having a projecting rod, the cylinder being arranged perpendicular to the axis of a manual hydraulic pump and supported pivotally and in a cantilever manner. This device is described in Japanese Utility Model Publication No. 62-72,727. The piercing punch of the above-mentioned type is shown on the left side of FIG. 6. In this drawing, reference numeral 1 designates a hollow cylindrical handle, 2 is a hand lever, 3 denotes a manual hydraulic pump, 4 is a hydraulic cylinder, 5 is a punch rod, 6 designates a distance collar, 7 is a fixed die, and 8 is a punch.

The punching tool of the above-described type has a shorter overall length and therefore, similar to a separated punch, could be used in narrow spaces. Punching could be easily performed without the help of an auxiliary worker. Freedom in selection of an angular position with respect to the manual pump of hydraulic cylinder 4 with punch rod 5 provides easier control of hand lever 2.

There may be cases, however, when configuration of a sheet-metal object to be treated may cause problems for the use of this tool. For example, when, as shown in FIG. 6, punch rod 5 is installed in a position perpendicular to a vertical portion of sheet-metal casing 9, there may be not enough room for positioning the tool in the vertical direction, and handle along with hand lever 2 must inevitably project from the casing in the downward direction. If there is no access from the bottom, it would be quite difficult to operate handle lever 2.

The present invention is aimed at the solution of the above problem by providing a piercing tool which has a handle and a hand lever that is switchable between perpendicular and parallel positions with respect to the punch rod projecting from the hydraulic cylinder.

This objective is achieved by a punching tool which comprises a hollow cylindrical handle with an oil reservoir within it, a manual hydraulic pump, and a hydraulic cylinder unit, all three elements being arranged in series. The manual hydraulic pump, is actuated through a pivoted hand lever, and sucks a working liquid from the reservoir and supplies it under pressure into the hydraulic cylinder unit. The hydraulic cylinder unit contains and moves a punch rod; while being moved, the punch rod compress a helical coil spring located within the cylinder. The rod is attached to a piercing punch which moves with respect to a fixed die and thus forms a hole in a sheet-like object clamped between the piercing punch and the fixed die. The punching tool is characterized by the fact that the manual hydraulic pump and the hydraulic cylinder unit are interconnected by an L-shaped tubular connector which has a through hydraulic channel. One end of the tubular connector is rotatingly connected to the manual hydraulic pump so that it can freely rotate around the longitudinal axis of the pump without interruption of communication between the hydraulic channel of the tubular connector and hydraulic channel of the manual hydraulic pump, while the other end of the tubular connector is rotatingly connected to the hydraulic cylinder unit so that it can be freely rotated around an axis which is perpendicular to the first-mentioned axis of said pump. The hydraulic cylinder unit and the tubular connector are mutually interconnected via hydraulic channels which are formed by an annular groove in the periphery of the axial element. The annular groove is connected to the channel inside this element, and the inner surface of the tubular portion is telescopically fitted onto the above-mentioned axial element for free rotation on the latter.

In use, the punching tool of the above-described type is held by hand at the hollow handle, and a fixed die with a hole of a required diameter is put onto a punching rod, if necessary, via a spacing collar. The protruding end of the punching rod is passed through a preformed hole of the sheet to be treated. The piercing punch is threaded onto the punching rod from the side opposite to the fixed die. The hand lever is then placed into a position convenient for operation by turning the manual hydraulic pump unit on the tubular connector with respect to the hydraulic cylinder, the axis of which is perpendicular to the surface of the treated sheet. Alternating the grip and release of the hand lever with respect to the hollow handle causes the supply of oil under pressure from the manual hydraulic pump via the tubular connector to the hydraulic cylinder unit. This in turn causes movement of the ram which slides within the cylinder and compresses the coil spring in contact with the ram. Since the ram pulls the punch rod into the cylinder unit, the piercing punch fits into the fixed die and shears the sheet being worked on. As a result, the preformed hole in this sheet is enlarged to the required diameter. The tool described above can be installed into any required position by rotating the tubular connector with respect to the cylindrical unit about an axis parallel to the axis of the cylinder and the hollow handle, or perpendicular thereto. At the same time, an arbitrary angular position of the manual hydraulic pump with respect to tubular connector can be chosen by rotating the pump on the tubular connector. Thus, at any time the hand lever can be installed in an easy-to-reach position by turning it with respect to the punching rod which is perpendicular to the sheet being treated.

DESCRIPTION OF A PREFERRED EMBODIMENT OF THE INVENTION

The invention will now be described in detail with reference to a preferred embodiment thereof and to the accompanying drawings.

Figure 1:
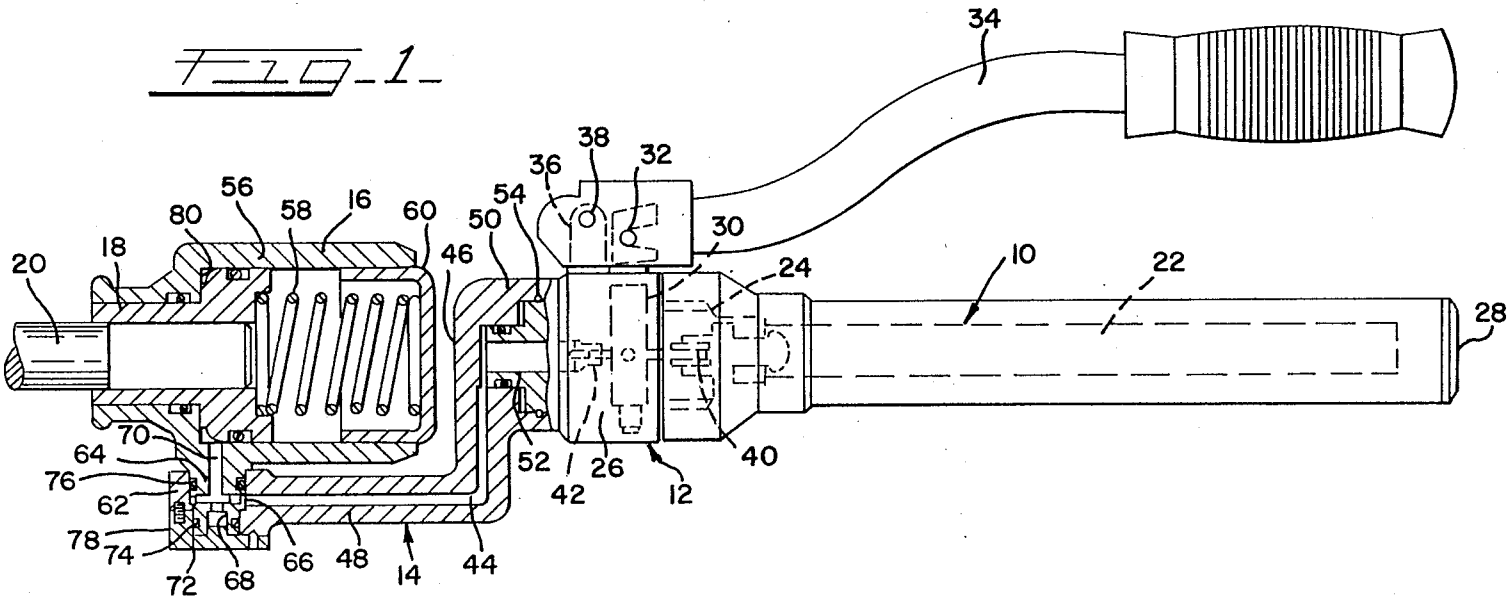
FIG. 1 is a side, partially sectional view of a punching tool made in accordance with an embodiment of the invention.
Figure 2:
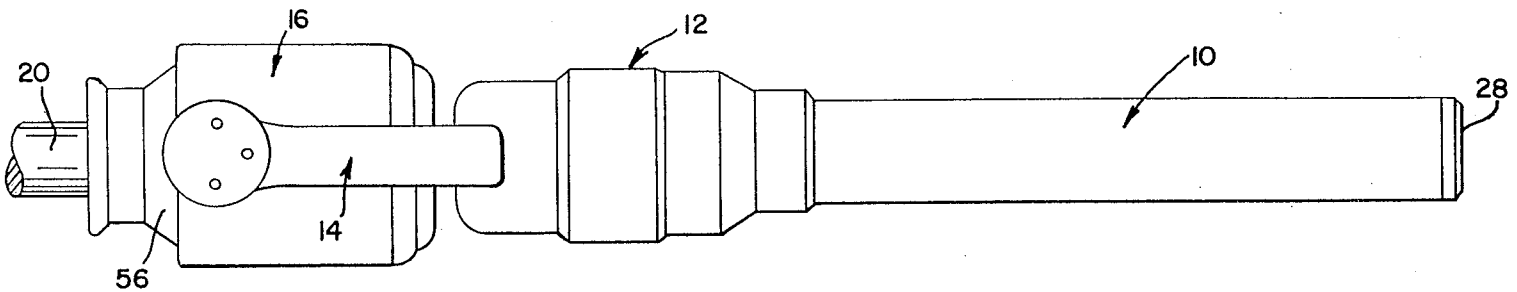
FIG. 2 is a view of the tool of FIG. 1 in the direction of the arrow.

FIG. 1 is a side, partially sectional view of a punching tool in accordance with an embodiment of the invention. FIG. 2 is a plan view of the tool of FIG. 1 taken in the direction indicated by the arrow. The tool of this embodiment consists of the following elements: a hollow cylindrical handle 10 with a reservoir for hydraulic liquid inside the handle; a manual hydraulic pump unit 12 connected to handle 10 and including a ball-type check valve and a plunger pump for drawing the hydraulic liquid from the above-mentioned reservoir and then supplying it under pressure; a tubular connector 14 to supply the hydraulic liquid from the plunger pump; a hydraulic cylinder unit 16 which is actuated by the hydraulic liquid supplied under pressure through the above-mentioned tubular connector 14; and a punch rod 20 which is screwed into the thread of a ram 18 of hydraulic cylinder unit 16. Punch rod 20 projects from hydraulic cylinder unit 16 and is removably secured to a fixed die and a piercing punch cooperating with the fixed die.

Hollow cylindrical handle 10 contains a pipe 22 which forms the above-mentioned reservoir for the hydraulic liquid. Pipe 22 is connected to hydraulic pressure pump block 26 through a large hollow nut 24 attached to the end of the pipe, e.g., by welding. The rear end of pipe 22 is stopped with a plug 28 having an oil-proof seal. Manual hydraulic pump 12 has a plunger 30 which slides within a cylinder formed in pump block 26. The upper end of plunger 30 has a U-shaped yoke which is connected to hand lever 34 through a pin inserted into the above-mentioned U-shaped yoke. Hand lever 34 is pivotally supported on pump block 26 by brackets 36 and pin 38.

A coil spring (not shown) located at the bottom of the above-mentioned cylinder urges plunger 30 outwardly. Manual hydraulic pump 12 is connected at one end to the oil reservoir formed inside handle 10 via a ball check valve, which is installed on the side of the oil reservoir of pump block 26. At the other end of pump 12, it is connected to the hydraulic cylinder via tubular connector 14 and a ball check valve installed on the side of the hydraulic cylinder of pump block 26. When the hand lever is pressed to the pump with one or both hands, plunger 30 is pushed into the above-mentioned cylinder; when the handle is then released, plunger 30 is returned to the initial position by the resilient force of the above-mentioned coil spring. Thus, repeated depression and release of hand lever 34 with pivoting motions of the lever on pin 36 causes reciprocations of plunger 30 within the cylinder. When plunger projects from the cylinder and returns into its initial position, a negative pressure is developed within the cylinder, so that a suction-type ball check valve 40 overcomes the compression force of the spring and opens. As a result, the hydraulic liquid is sucked from the reservoir of handle 10 into the cylinder. A subsequent retraction of the plunger 30 compresses the oil which has been sucked into the cylinder. This action automatically blocks the suction-type ball check valve 40, while a discharge-type ball check valve 42 overcomes the force of the spring and opens, so that the oil under pressure is fed into passage 44 of tubular connector 14.

Tubular connector 14 comprises two mutually perpendicular parts, i.e., a connection portion 46 and an oil-supply portion 48. Connection portion 46 is pivotally connected to the front end of manual hydraulic pump 12 so that it can rotate around an axis perpendicular to its longitudinal direction. More specifically, portion 46 has a short supporting element 50 which is perpendicular to connection portion 46. Element 50 has a step-like bore. In a step-like cylindrical projection 52 formed on the front end pump block 26 is inserted into the step-like bore of element 50. This connection provides free rotation of one part with respect to the other. In order to hold tubular connector 14 on manual hydraulic pump unit 12 without the separation of both parts, aligned radial grooves are formed respectively on the inner step-like peripheral surface element 50 and on the outer peripheral surface of step-like cylindrical projection 52. A split spring ring 54 is inserted into both grooves, so that it holds both parts together against relative axial movements and at the same time, due to its spring-loaded contact with the walls of the mating grooves, holds tubular connector 14 at the required angular position with respect to manual hydraulic pump 12, when the tubular connector is turned into the above-mentioned position about the longitudinal axis of the pump.

As has been mentioned above, a discharge-type ball check valve 42, which connects the oil supply channel with passage 44 of tubular connector 14 for the supply of the oil under pressure, is installed in cylindrical projection 52.

Ram 18, which is threaded onto punching rod 20, telescopically slides in cylinder block 56 of hydraulic cylinder unit 16. The end face of ram 18 serves as a seat for helical spring 58, the other end of which is inserted into cap 60 threaded into cylinder block 56.

Figure 5:
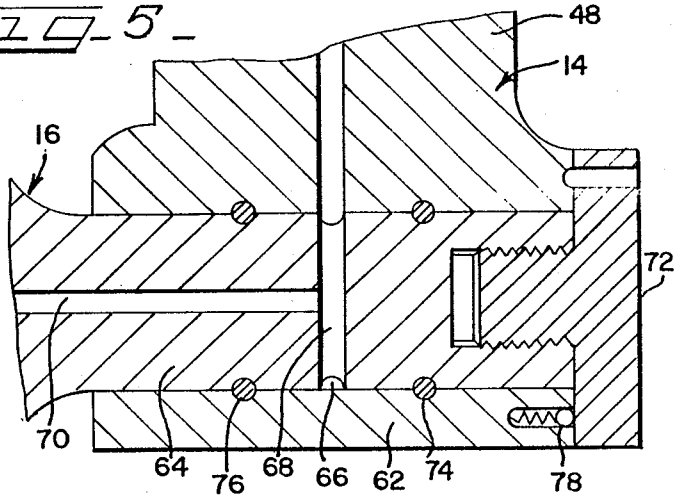
FIGS. 4 and 5 are cross-sectional views along lines A—A and B—B of FIG. 3 respectively.
Figure 3:
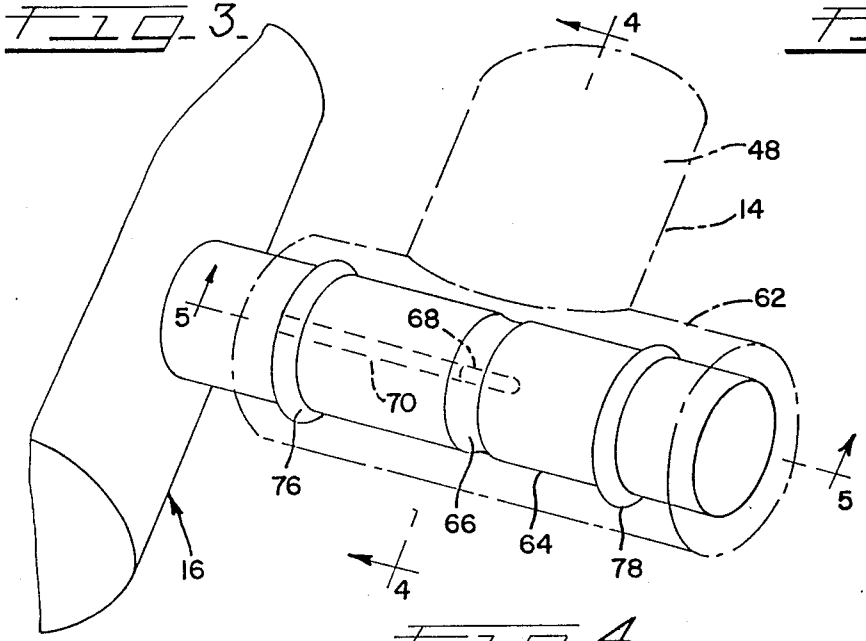
FIG. 3 is a perspective view of an axle portion of a hydraulic cylinder.
Figure 4:
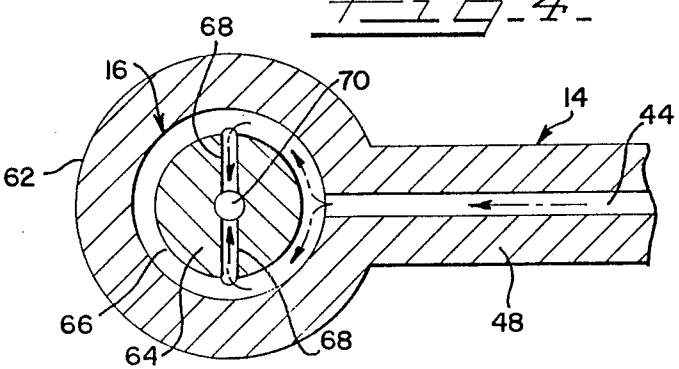

The above-mentioned hydraulic cylinder unit 16 is installed in a manner permitting rotation on the end of oil-supply portion 48 of tubular connector 14. The construction of the connection part of hydraulic cylinder unit 16 is shown in FIG. 3. FIGS. 4 and 5 are respective sectional views along lines A—A and B—B of FIG. 3. More specifically, oil-supply portion 48 is made integral with cylindrical element 62 which is perpendicular to the axis of oil-supply portion 48. The end of passage 44 is open to the inner wall of cylindrical element 62. On the other hand, cylinder block 56 of hydraulic cylinder unit 16 has an axial projecting portion 64 which supports the above-mentioned cylindrical element 62 in a manner which permits rotation. The peripheral surface which corresponds to the open end of the above-mentioned passage 44 of axial portion 64 has an annular groove 66. A diametrical hole 68, which passes through portion 64 in the annular groove, connects groove 66 with oil supply channel 70. Plug 72 holds cylindrical element 62 and axial element 64 together, yet allows rotation with respect to each other while keeping annular groove 66 and passage 44 aligned. Cylindrical element 62 and channel 70 are sealed by seal rings 74 and 76 located on both sides of annular groove 66. Working fluid, admitted to channel 70 from oil passage 44 via annular groove 66 and through hole 68, penetrates into the annular space 80 formed between ram 18 and cylinder block 56. The relative angular position between cylindrical element 62 and axial portion 64 is fixed by means of stopper ball 78.

With the above-described connection between cylindrical element 62 and axial portion 64, pump 12 can be rotated on tubular connector 14 into a position perpendicular to cylinder 16, or can be turned into the position shown in FIG. 1, in which cylinder unit 16 is coaxial with manual hydraulic pump 12.

OPERATION

Figure 6:
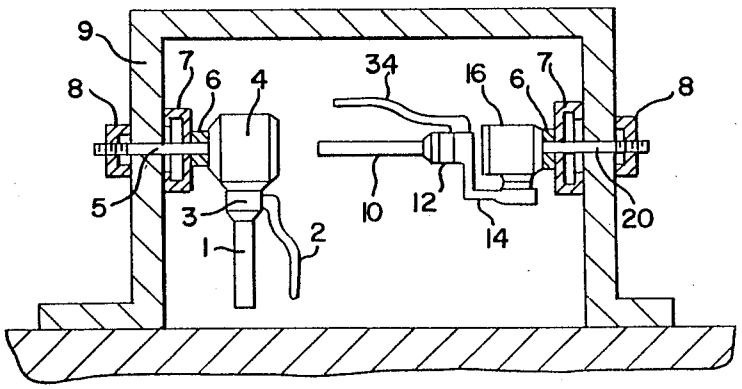
FIG. 6 an explanatory view which shows application conditions of the tool.

The tool made in accordance with the above-described embodiment of the invention operates in the following manner:

First, the tool is attached to a sheet-metal object 9, which has to be treated, into a position shown on the right side of FIG. 6. Parts and elements which are identical to those shown on the left side of the same drawing are designated by the same reference numerals. Distance collar 6, fixed die 7, piercing punch 8, and punching rod 20 are attached in the same manner as has been described before.

When, in the position shown in FIG. 6, the tool is driven into action by periodically pressing hand lever 34 toward handle 10 and releasing it, the tool begins to supply oil under pressure into hydraulic cylinder unit 16 from pump 12 via passage 44 of tubular connector 14. Ram 18 begins to move into cylinder block 56 and at the same time compresses coil spring 58. The ram moves along with punching rod 20 which is connected thereto, and therefore is withdrawn into cylinder unit 16. As a result, sheet 9 is sheared between piercing punch 8 and fixed die, and the preformed opening is enlarged to the final diameter.

When, under conditions shown in FIG. 1, manual hydraulic pump 12 is turned with respect to tubular connector, hand lever 34 can be set at any angular position within 360° with respect to the hydraulic cylinder. At the same time, rotation of tubular connector 14 with respect to hydraulic cylinder 16 allows hand lever 34 to be placed at the required angular position between the position coaxial with the cylinder and perpendicular to the cylinder. Thus, depending on the specific configuration of object 9, hand lever 34 can be set at the position most convenient for operation. With the configuration of object 9 as shown in FIG. 6, hand lever 34 can be most easily grasped when positioned behind cylinder 16 and oriented perpendicular to sheet 9 to be punched. Therefore in this case the manual pump is arranged coaxially with hydraulic cylinder 16. When tubular connector 14 is turned with respect to hydraulic cylinder 16, the open end of channel 44 of tubular connector remains aligned with annular groove 66. Therefore, irrespective of the angular position of the tubular connector, the oil which was supplied through channel 44 will be fed to passage 70 via through hole 68 from a channel formed between the inner surface of cylindrical portion 62 and annular groove 66.

Thus it has been shown that the punching tool of the invention has a handle and a hand grip which can be installed in any position convenient for use, so that the punching operation can be performed easily, irrespective of the configuration of the object being treated. This is achieved due to the fact that the manual hydraulic pump is rotatingly connected to one end of a tubular connector, while the other end of this tubular connector is connected to a hydraulic cylinder in such a manner that the tubular connector can be turned about an axis perpendicular to the axis on the other end thereof.

The tubular connector and the hydraulic cylinder unit are hydraulically interconnected through mutually communicating channels formed by an annular groove, which is cut in the periphery of the axial element and is connected to the channel inside this element, and the inner surface of the tubular portion fitted onto the above-mentioned axial element for free rotation on the latter. The above-mentioned channels maintain their communication even though the parts are moveable with respect to each other. Therefore the oil will be supplied smoothly from the pump to the hydraulic cylinder at any angular position of the tubular connector.

What I claim is:

1. A tool for punching holes in a sheet fixed between a punch and a die comprising, in series, a cylindrical handle having an oil reservoir, a manual hydraulic pump, and a hydraulic cylinder unit, said manual hydraulic pump being actuatable by a pivoted hand lever, and capable of drawing a working fluid from said reservoir to supply fluid under pressure into said hydraulic cylinder unit for containing and moving a punch rod in a reciprocal manner, said manual hydraulic pump having a hydraulic channel, the movement of said punch rod compressing a coil spring within the cylinder, said rod being secured to said punch which moves with respect to said die to form a hole in said sheet, wherein said manual hydraulic pump and said hydraulic cylinder unit are interconnected by a tubular connector having a through hydraulic channel, said manual hydraulic pump having a longitudinal axis, one end of said tubular connector being rotatingly connected to said manual hydraulic pump for free rotation about the longitudinal axis of said pump without interruption of communication between said hydraulic channel of said tubular connector and said hydraulic channel of said manual hydraulic pump, while the other end of said tubular connector is rotatingly connected to said hydraulic cylinder unit so that it can be freely rotated about an axis perpendicular to the longitudinal axis of said pump, said hydraulic cylinder unit and said tubular connector being connected to each other by an annular groove within said pump.

2. The tool of claim 1 wherein said hydraulic cylinder and said tubular connector are connected to permit rotation of said tubular portion on said hydraulic cylinder unit.

3. The tool of claim 1 wherein said tubular connector is L-shaped.

4. The tool of claim 1 wherein said working fluid is a hydraulic liquid.

5. The tool of claim 1 wherein said oil reservoir is within said handle.

* * * * *